US006443075B1

(12) United States Patent
Hahn et al.

(10) Patent No.: US 6,443,075 B1
(45) Date of Patent: Sep. 3, 2002

(54) SAFETY INTERLOCK BRAKING SYSTEM FOR HEIGHT ADJUSTABLE TABLE

(75) Inventors: Christopher T. Hahn, Dothan, AL (US); Peter J. Kerl, Angola; Ahmad Sith, Lakewood, both of NY (US); Holly M. Carlson, Wattsburg, PA (US)

(73) Assignee: Weber Knapp Company, Jamestown, NY (US)

( * ) Notice: Subject to any disclaimer, the term of this patent is extended or adjusted under 35 U.S.C. 154(b) by 0 days.

(21) Appl. No.: 09/700,232

(22) PCT Filed: Mar. 29, 2000

(86) PCT No.: PCT/US00/08317

§ 371 (c)(1),
(2), (4) Date: Nov. 13, 2000

(87) PCT Pub. No.: WO01/72170

PCT Pub. Date: Oct. 4, 2001

(51) Int. Cl.[7] ..... A47B 9/00
(52) U.S. Cl. ..... 108/147; 248/188.2
(58) Field of Search ..... 108/147, 144.11, 108/146, 148, 10; 248/188.5, 162.1, 188.2

(56) References Cited

U.S. PATENT DOCUMENTS 3,976,016 A * 8/1976 Longbottom
4,747,353 A * 5/1988 Watt ..... 108/147 X
4,981,085 A 1/1991 Watt ..... 108/147
5,289,782 A * 3/1994 Rizzi et al. ..... 108/147
5,311,827 A * 5/1994 Greene ..... 108/147
5,438,939 A * 8/1995 Clarke ..... 108/144.11
5,456,191 A * 10/1995 Hall ..... 108/147
5,598,788 A * 2/1997 Jonker ..... 108/147
5,598,789 A 2/1997 Jonker ..... 108/147
5,682,825 A * 11/1997 Manner ..... 108/147 X
5,687,655 A * 11/1997 Weinschenk, Jr. et al. .. 108/147
5,778,799 A * 7/1998 Eyre ..... 108/147 X
5,778,803 A * 7/1998 Machael ..... 108/147
5,797,331 A 8/1998 Watt ..... 108/146
5,941,182 A * 8/1999 Greene ..... 108/147
6,026,755 A * 2/2000 Long ..... 108/147
6,038,986 A * 3/2000 Ransil et al. ..... 108/147 X
6,152,049 A * 11/2000 Schmidt ..... 108/147

* cited by examiner

*Primary Examiner*—Jose V. Chen
(74) *Attorney, Agent, or Firm*—Simpson & Simpson, PLLC

(57) ABSTRACT

A height adjustable mechanism for supporting a work surface for vertical movement relative to a base includes a counterbalance mechanism for providing a force opposing a downward force tending to lower the work surface; a brake mechanism for releasably retaining the work surface in a desired vertical position; a user operated release mechanism for selectively releasing the brake mechanism to permit vertical movement of the work surface; and an interlock mechanism for preventing release of the brake mechanism if the force and the downward force are out of balance by some given extent. In the preferred construction, the interlock mechanism includes an interlock plate supported by the base for pivotal movement between first and second blocking positions when the force is less than and greater than the downward force, respectively, through a neutral position when the force essentially corresponds to the downward force, and the release mechanism engages with the interlock plate when in the blocking positions thereof to prevent release of the brake mechanism by a user.

15 Claims, 7 Drawing Sheets

SAFETY INTERLOCK BRAKING SYSTEM FOR HEIGHT ADJUSTABLE TABLE

FIELD OF THE INVENTION

The invention relates to height adjustment mechanisms for work surfaces, such as table tops.

BACKGROUND OF THE INVENTION

It is known to provide a height adjustment mechanism for a work surface including a counterbalance mechanism for providing a counterbalance force opposing a downward force including tending to lower the work surface, a brake mechanism for releasably retaining the work surface in a desired vertical position, and a manual operated release mechanism for selectively releasing the brake mechanism to permit vertical movement of the work surface, as evidenced by U.S. Pat. Nos. 2,892,050; 3,213,809; and 5,797,331. Further, it is known to provide means for preventing release of the work surface for vertical movement when the counterbalance force and the downward force are out of balance, as evidenced by U.S. Pat. No 5,706,739 and commonly assigned U.S. application Ser. No. 09/215,838.

SUMMARY OF THE INVENTION

The present invention is generally directed towards a height adjustment mechanism for a work surface and more particulars to a mechanism employing a brake mechanism for releasably retaining the work surface in a desired vertical position and a manual operator for selectively releasing the brake mechanism, except when a vertically downwardly directed force acting on the work surface differs by some given amount from a counterbalance force tending to oppose downward movement of the work surface.

More specifically, the present invention is directed towards an improved interlock mechanism particularly adapted to be used with a counterbalance table mechanism of the type described in U.S. Pat. No. 5,797,331, wherein release of the brake mechanism is prevented when the force exerted by a counterbalance mechanism on the work. surface differs by some given extent from a downwardly directed force acting on such work surface.

In accordance with the present invention, the interlock mechanism includes an interlock plate pivotally supported by the base or frame of a table mechanism to undergo movement between fist and second blocking positions when the counterbalance force is less than and greater than the downward force, respectively, through a neutral position, wherein the force essentially corresponds to the downward force, and the brake mechanism is freed for release by a user.

BRIEF DESCRIPTION OF THE DRAWINGS

The nature and mode of operation of the present invention will now be more fully described in the following detailed description taken with the accompanying drawings wherein.

DETAILED DESCRIPTION OF THE PREFERRED EMBODIMENT

Figure 1:
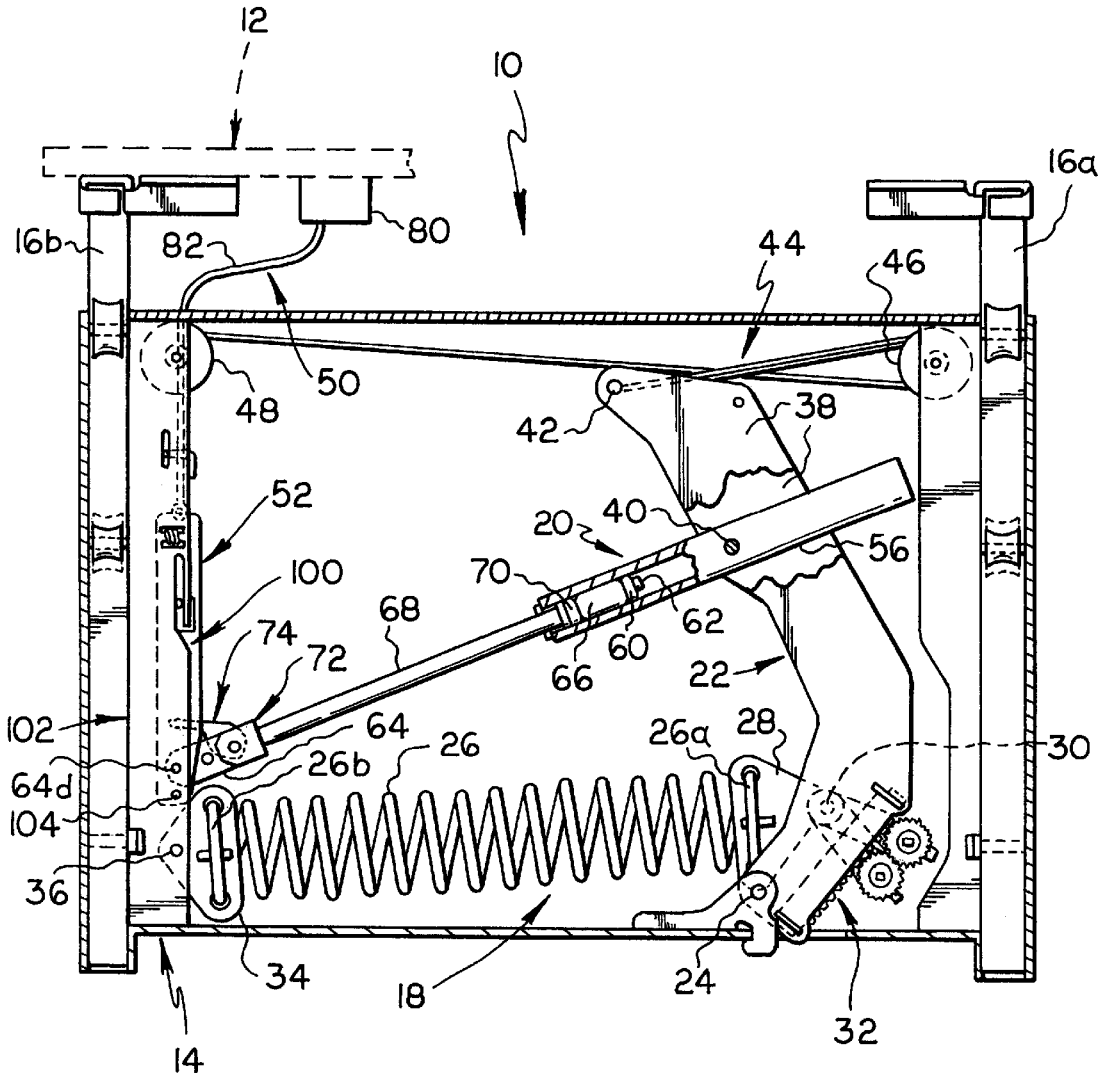
FIG. 1 is a rear elevational view of a table mechanism with its work surface disposed in a lowered position in which parts, including a privacy panel, are broken away for purposes of clarity.
Figure 2:
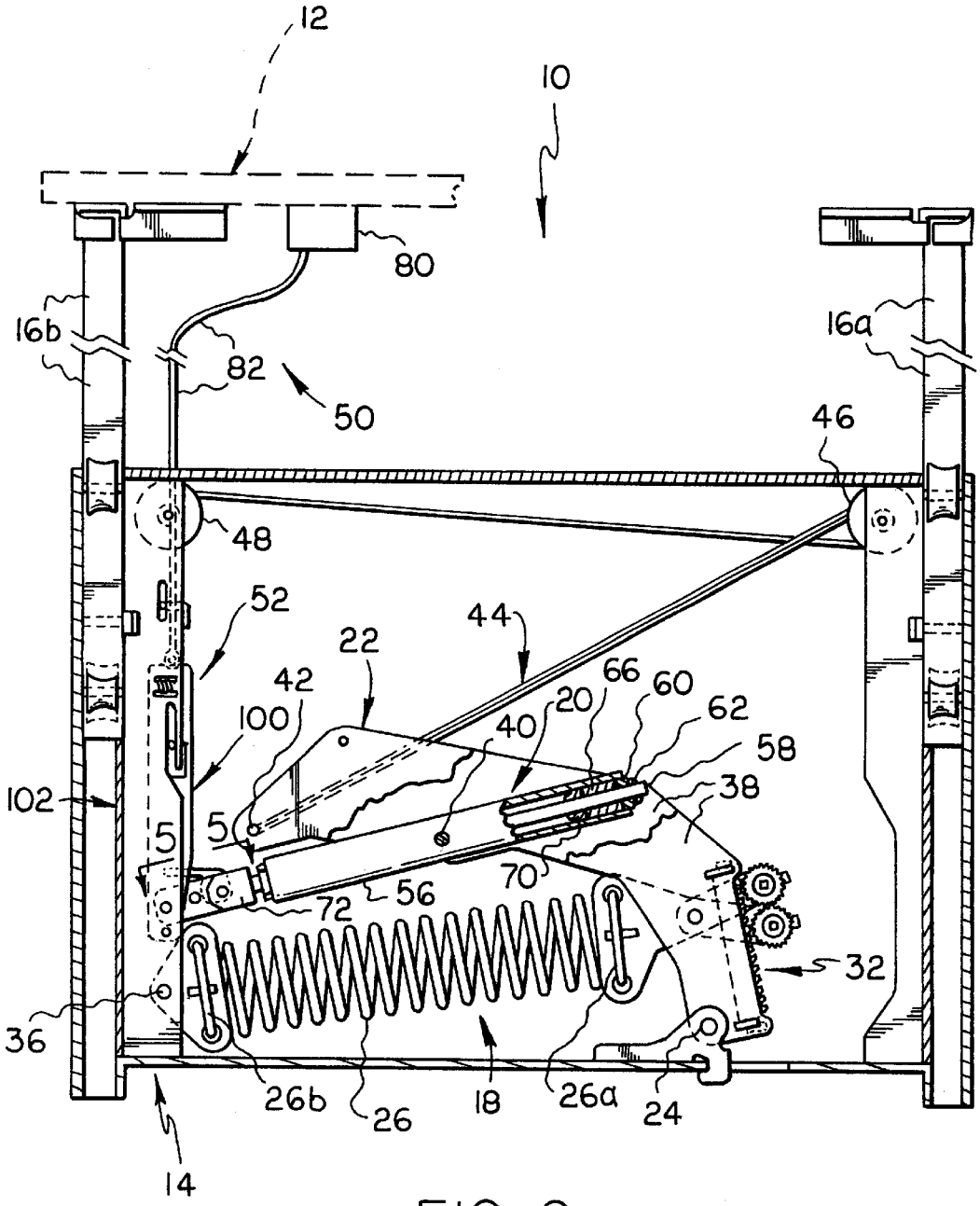
FIG. 2 is a view similar to FIG. 1, but with the work surface disposed in an elevated or upper position.

Reference is first made to FIGS. 1 and 2, wherein a table is generally designated as 10 and shown as having a work surface or top 12 supported for vertical movement relative to a base 14 between lower and upper positions, shown respectively, in FIGS. 1 and 2, by a pair of columns 16*a* and 16*b*, which are suitably guided by the base for vertical reciprocating movement under the control of a counterbalance mechanism 18 and a brake mechanism 20.

Counterbalance mechanism 18 is generally shown as including a member 22 coupled to base 14 by a pivot pin 24 for pivotal movement about a horizontally disposed axis and biasing means. The biasing means may be defined by a coil spring 26 having a first end 26*a* connected to member 22 for adjustment of the moment arm through which the spring acts via a connector plate 28, a pivot pin 30 and a rack and gear assembly 32; and a second end 26*b* connected to base 14 via a connector plate 34 and a pivot pin 36. Member 22 may be defined by a pair of parallel plates 38 and 38 having first ends bored to receive pivot pin 24; mid-portions bored to receive a pivot pin 40, which serves to pivotally connect the member to brake mechanism 20; and second ends bored to receive a connector pin 42.

Member 22 is coupled to columns 16*a* and 16*b* via flexible cable 44 having its opposite ends, not shown, suitably fixed to the lower ends of the columns and a mid-portion fixedly located by connector pin 42. A cable first end is trained over a first double pulley 46 in passing for attachment to the lower end of column 16*a* and a cable second end is trained successively over pulley 46 and a second pulley 48 in passing for attachment to the lower end of column 16*b*.

With this arrangement, surface 12 moves upwardly from its lowermost position of FIG. 1 into its uppermost position of FIG. 2 incident to counterclockwise swinging movement of member 22 about pivot pin 24, as viewed in FIG. 1. The bias of spring 26 acting on member 22 about the axis of pivot pin 24 creates a vertically upwardly directed counterbalance force tending to oppose a downwardly directed force acting on work surface 12 resulting from the weight of the work surface 12, columns 16*a* and 16*b*, and an object placed by a user on the work surface. The value of the counterbalance force may be selectively varied by user adjustments of rack and gear assembly 32.

As thus far described, the construction of table 10 is known and described more particularly in commonly assigned. U.S. Pat. No. 5,797,331, whose disclosure is incorporated by reference herein.

In the prior table mechanism described above, a manual operator carried by work surface 12 was connected by an operating cable directly to the brake mechanism, whereby to permit the brake mechanism to be released to permit vertical movement of the work surface whenever a user chooses to operate the manual operator.

In accordance with the present invention, a user operated brake release mechanism 50 to be described with particular reference to FIGS. 3–10 is coupled to brake mechanism 20 under the control of an interlock mechanism 52, which serves to prevent release of the brake mechanism, when ever the counterbalance force differs to some given extent from the downwardly directed force acting on work surface 12 Thus, for example, release of an otherwise properly balanced work surface would be prevented while an additional temporary loading were applied to a work. surface, such as that resulting from a person leaning or resting on such work surface.

Brake mechanism 20 of the present invention differs from that described in U.S. Pat. No. 5,797,331 in that it generally includes in combination an open-ended brake cylinder 56 connected to member 22 by pivot pin 40; a brake rod 58 having a first end received within the brake cylinder and mounting a first. pressure applying member 60 retained by a nut 62 and a second end disposed outwardly of the brake cylinder and carrying a head member 64; a resiliently deformable piston head 66 sized to be slidably received by the brake cylinder when in a non-deformed. condition and having an axially extending through opening for receiving the brake rod; a pusher tube 68 disposed concentrically outwardly of the brake rod and having a first end disposed within the brake cylinder and mounting a second pressure applying member 70 and a second end disposed outwardly of the brake cylinder and mounting a slide member 72; and a cam member 74.

Head member 64 is of U-shaped configuration having parallel side flanges 64*a* and 64*a*, which are formed with a pair of aligned, elongated mounting openings 64*b* and 64*b*, and three pairs of aligned bore openings, which support opposite ends of pivot pins 64*c*, 64*d* and 64*e*. Pivot pin 64*c* in turn serves to support a cylindrical bearing surface 64*f*.

Slide member 72 is of U-shaped configuration having parallel side flanges 72*a* and 72*a*, which are arranged to slidably engage with side flanges 64*a* and 64*a* and formed with a pair of aligned bore openings to support a pivot pin 72*b* rotatably and slidably received within mounting openings 64*b* and 64*b*, and a base flange 72*c* formed with a bore opening 72*d* for slidably receiving brake rod 58.

Cam member 74 is through bored to receive pivot pin 72*b*, formed with an elongated cam end portions 74*a* and 74*a* through bored to receive a pivot pin 74*b* and formed with a cam surface 74*c* arranged to bear against bearing surface 64*f*.

Brake release mechanism 50 is shown as including a suitable manually operable release mechanism 80 supported by work surface 12; an operating cable 82 having one end coupled to the release mechanism and an opposite end terminating in an eyelet 84; a compensating spring 86; a release bracket 88 mounting a bearing pin or follower 90; and a return spring 92. Compensating spring 86 has its opposite ends connected to eyelet 84 and release bracket 88 via. bearing pin 90. Release bracket 88 is of U-shaped configuration having parallel side flanges 88*a* and 88*a* whose upper ends are provided with aligned bore openings for supporting bearing pin 90 and whose lower ends are provided with aligned bore openings for receiving pivot pin 74*b*, whereby to pivotally connect the release bracket to cam end portions 74*a* and 74*a* by pivot pin 74*b*. Return spring 92 has its opposite ends connected to bearing pin 90 and head member 64 via pin 64*e*.

Figure 4:
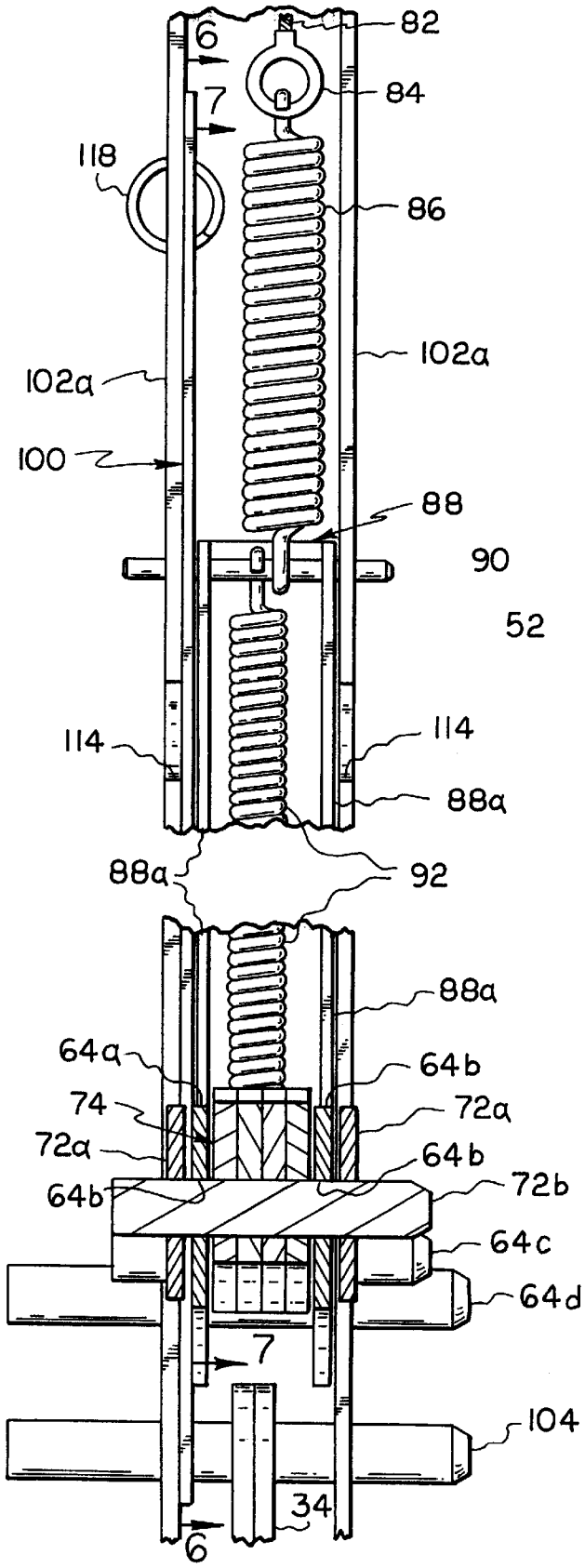
FIG. 4 is a side elevational view of the left hand side of the mechanism of FIG. 1, as viewed from the right thereof
Figure 5:
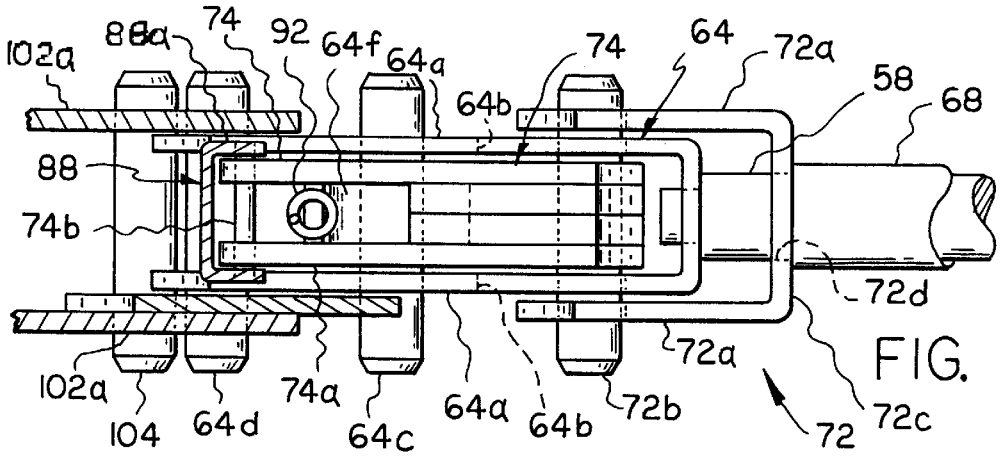
FIG. 5 is a sectional view taken generally along the line 5—5 in FIG. 2.

Interlock mechanism 52 includes an interlock plate 100, which is arranged intermediate the left hand side flange 88*a* of release bracket 88 and the left hand one of a pair of side flanges 102*a* and 102*a*of a rigid, upstanding, U-shaped structural member 102 as viewed in FIG. 4. Interlock plate 100 has its lower end formed with a bore opening for receiving a pivot pin 104 whose ends are received within a pair of bore openings provided within side flanges 102*a* and 102*a*, a bore opening for receiving pivot pin 64*d* whose opposite ends are received within a pair of horizontally elongated motion limiting slots 106 and 106 provided within side flanges 102*a* and 102*a*; its upper end formed with a reclined generally H-shaped spring mounting opening 108; and its mid-portion formed with a release control opening 110. Release control opening 110 is bounded in part by aligned, downwardly facing first and second blocking surfaces 110*a* and 110*b* adapted for alternate engagement by bearing pin 90 for purposes of preventing release of brake mechanism 20 by release mechanism 50 when interlock plate is pivoted about the axis of pin 104 into either of its first and second blocking positions shown in FIGS. 8 and 9. Blocking surfaces 110*a* and 110*b* are arranged to extend generally horizontally from adjacent opposite sides of a vertically upwardly extending release passageway 110*c*, which is sized to permit free upward movement of bearing pin 90, whenever the bearing pin is disposed horizontally intermediate the blocking surfaces incident to pivotal movement of interlock plate 100 into its neutral position shown in FIG. 10 and release mechanism 50 is manually operated.

Figure 3:
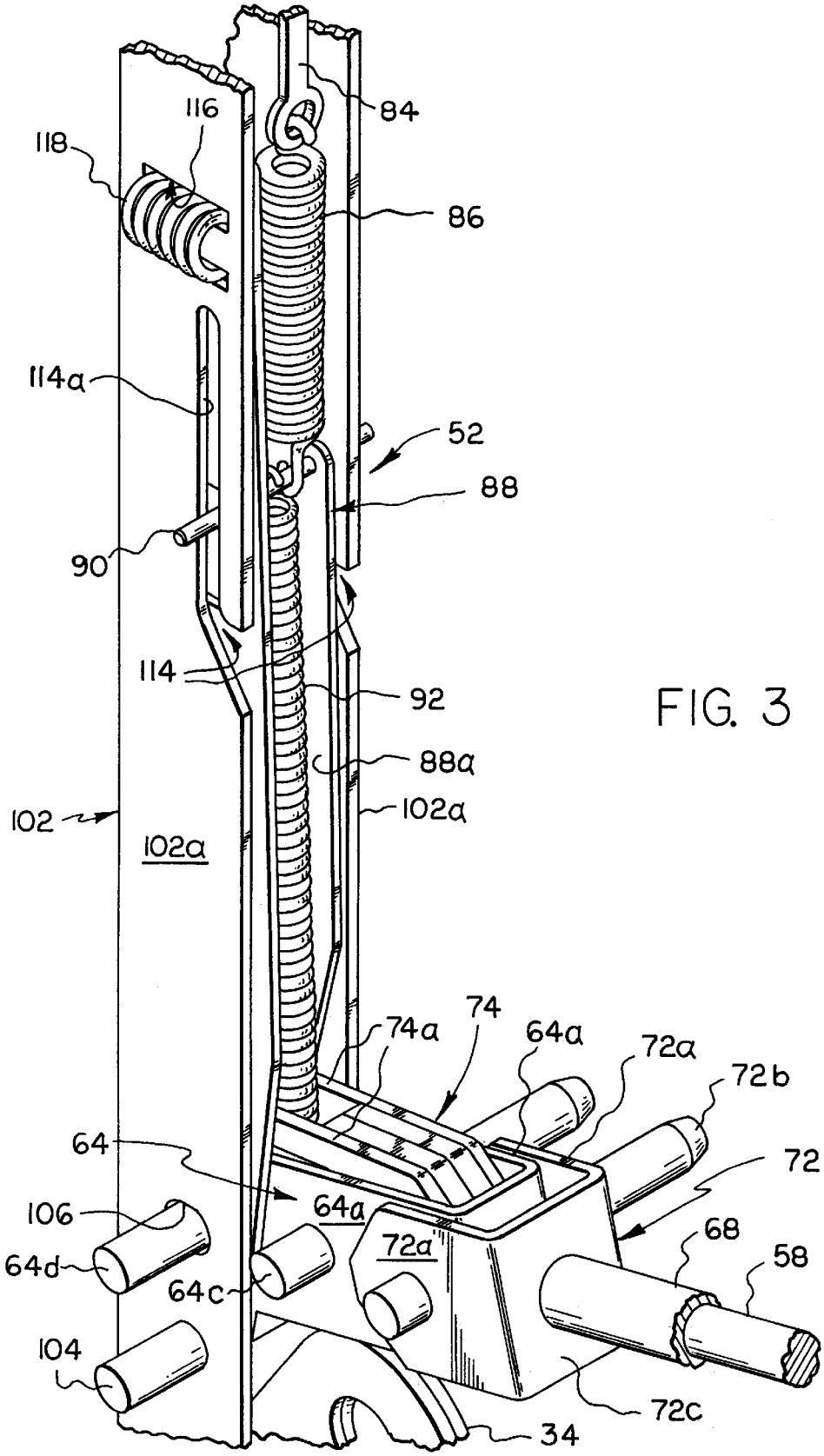
FIG. 3 is a fragmentary prospective view of the left hand side of the mechanism of FIG. 1.

As shown in FIG. 3, each of structural member side flanges 102*a* and 102*a* is formed with an assembly opening 114, which opens through one side edge there of to permit insertion of bearing pin 90 thereinto and terminates in a vertically upwardly extending release passageway 114*a*, which serves to constrain bearing pin 90 for movement along a vertical path of travel, as the latter moves vertically within control opening 110 and release passageway 110*c*. Structural member side flanges 102*a* are also formed with a reclined generally H-shaped spring mounting opening 116.

Interlock mechanism 52 is completed by the provision of a coil return spring 118 supported within H-shaped openings 108 and 116.

Figure 8:
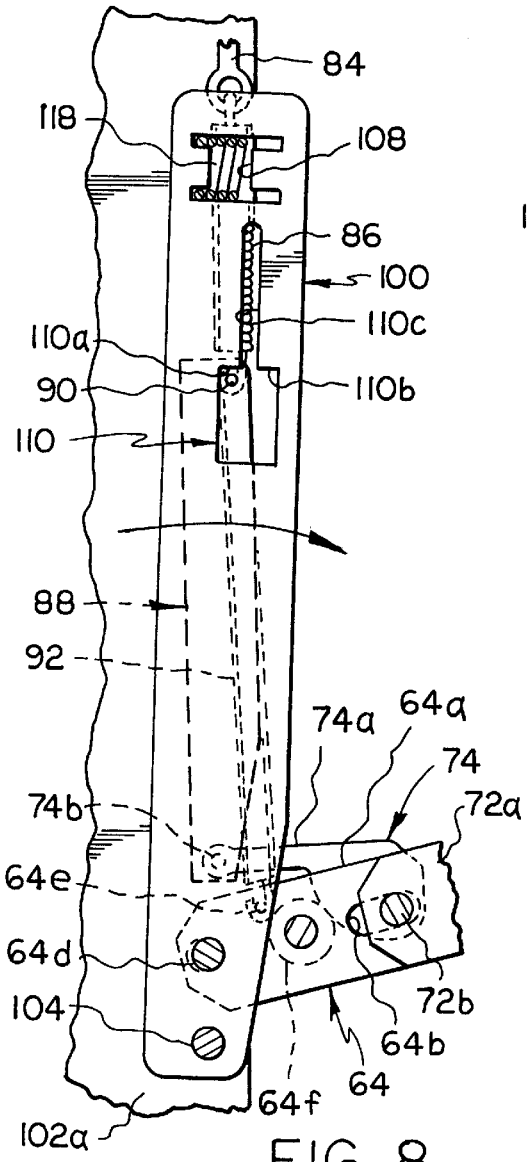
FIG. 8 is a view taken generally along the line 6—6 in FIG. 4, but showing the interlock plate in a first blocking position to prevent release of the brake mechanism.
Figure 9:
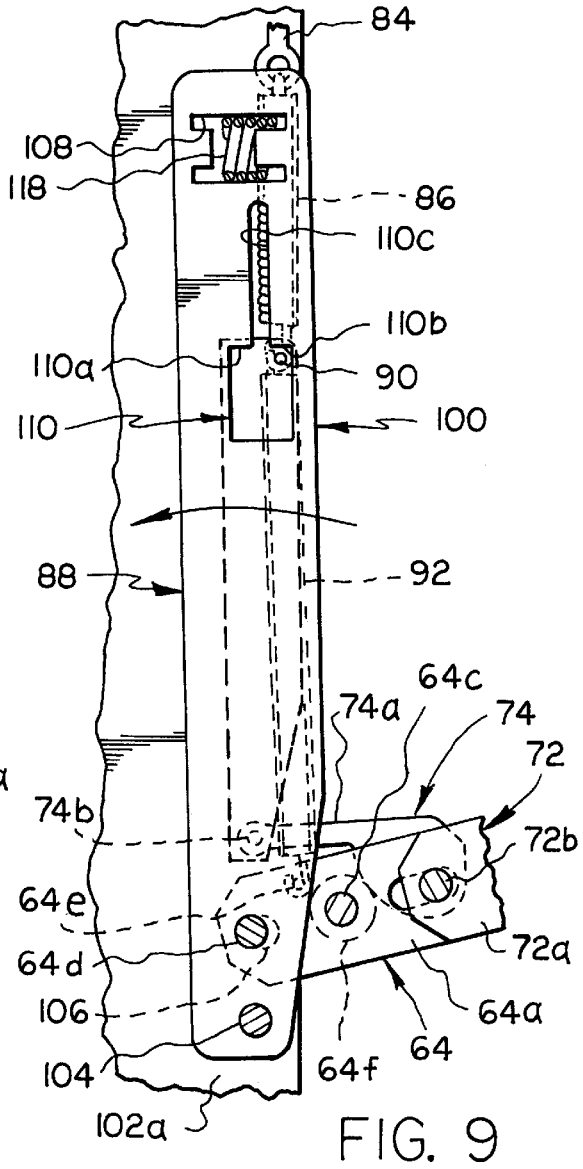
FIG. 9 is a view similar to FIG. 8, but showing the interlock plate in a second blocking position thereof
Figure 6:
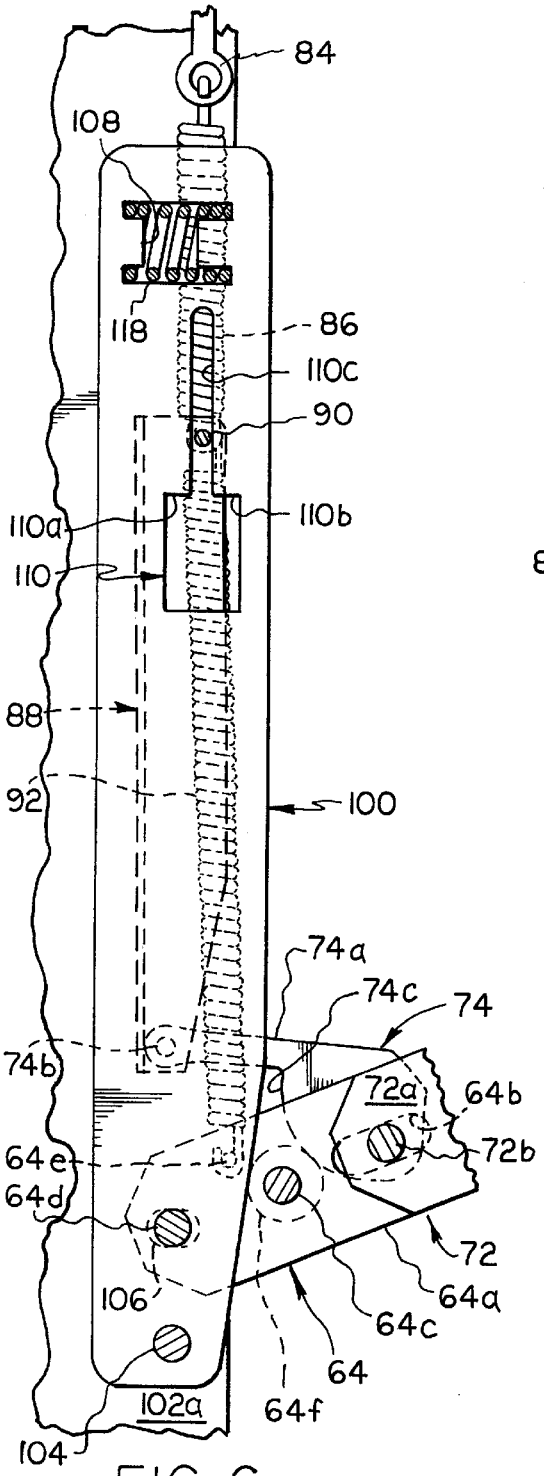
FIG. 6 is a sectional view taken generally along the line 6—6 in FIG. 4 and showing the mechanism in brake release condition.
Figure 7:
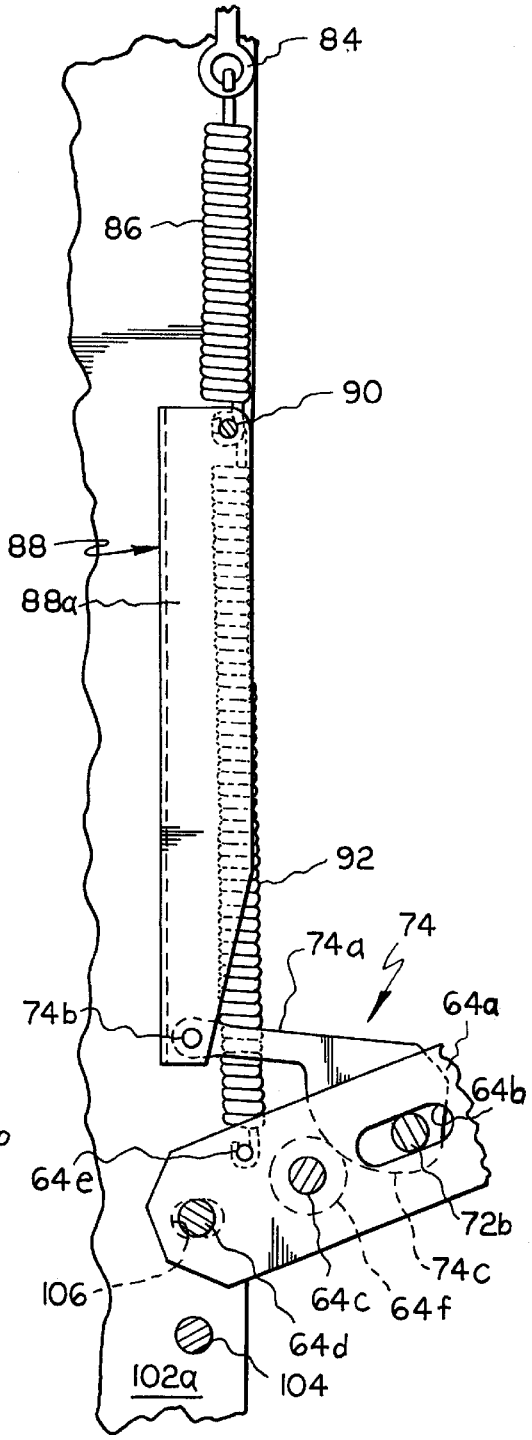
FIG. 7 is a sectional view taken generally along the line 7—7 in FIG. 4.
Figure 10:
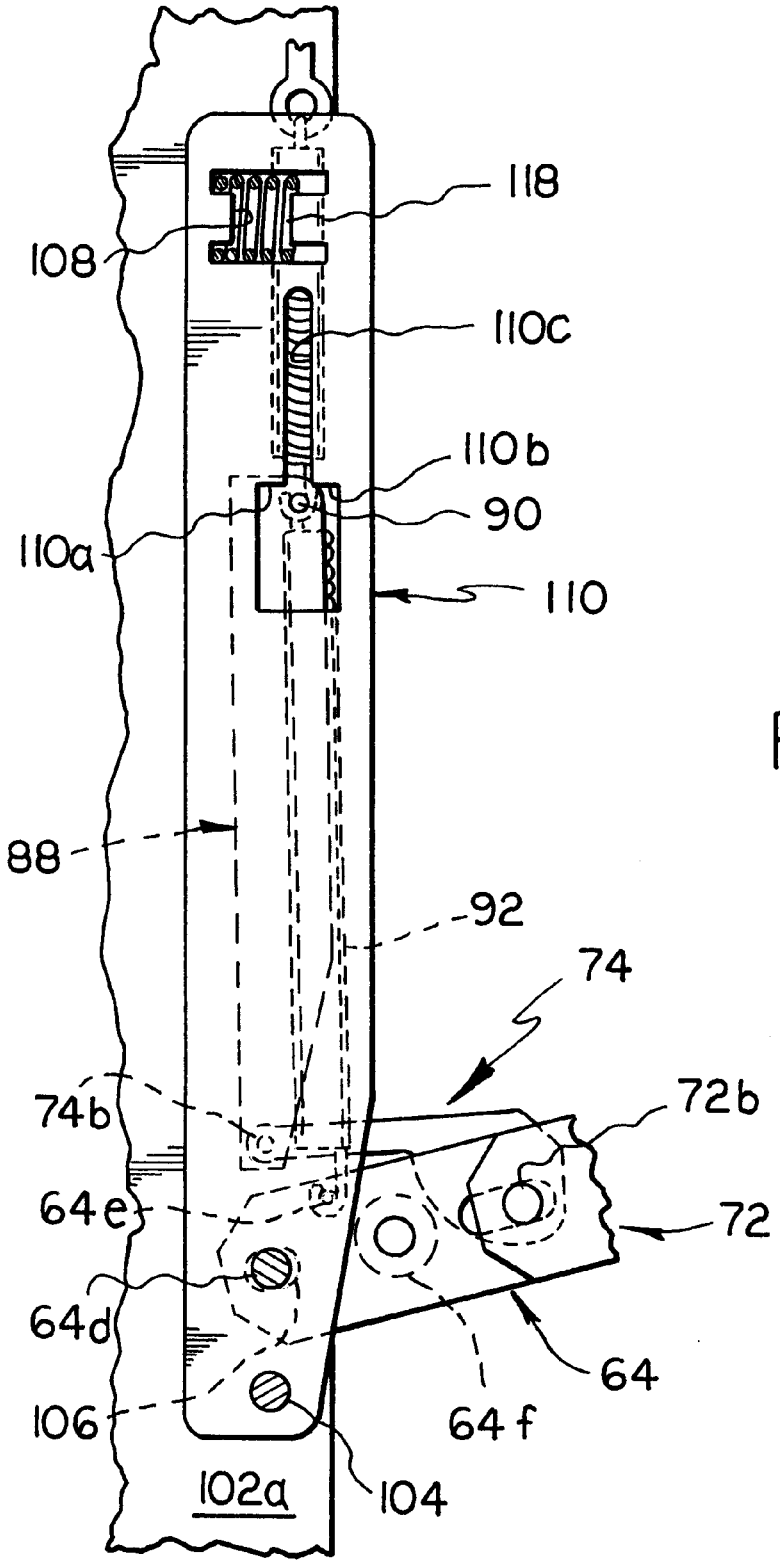
FIG. 10 is a view similar to FIGS. 8 and 9, but showing the interlock plate in its neutral or intermediate position in order to perm subsequent release of the brake mechanism

Passageways 110*c* and 114*a* are arranged for alignment when interlock plate 100 is disposed in its neutral position shown in FIG. 10, and spring 118 is progressively compressed incident to pivotal movement of interlock plate away from its neutral position into either of its blocking positions shown in FIGS. 8 and 9. Thus, spring 118 tends to bias interlock plate 100 for return to its neutral position, and helps control how much of a force mismatch or difference between the counter balance force and the force tending to lower work surface 12 is required to move interlock plate into its blocking positions.

To facilitate description of the operation of the present invention, it will first be assumed that work surface 12 is retained in a desired elevated position by brake mechanism 20 and that the counterbalance force exerted by mechanism 22 essentially corresponds to the force tending to lower the work surface. In this balanced operating condition, pivot pin 64*d* is disposed adjacent the midpoint of elongated slots 106 and 106 and interlock plate 100 is maintained in its neutral or intermediate position, as shown in FIG. 10, by operation of spring 118. Then, when a user desires to release brake mechanism 20, the user would operate mechanism 80 with the result that bearing pin 90 would be drawn upwardly within passageway 110*c* against the return bias of spring 92 and the connection between release bracket 88 and cam end portions 74*a* and 74*a* would cause cam member 74 to pivot about the axis of pivot pin 72*b* into the position shown in FIGS. 6 and 7. As a result, cam bearing surface 74*c* rides up on cylindrical bearing surface 64*f* to permit pivot pin 72*b* and slide member 72 to move relative to head member 64 towards pivot pin 64*d* under the axially expansive bias of piston head 66 tending to move second pressure applying member 70 axially away from first, pressure applying member 60. As piston head 66 is permitted to expand axially, it. also contracts radially, whereby to free its outer surface from frictional braking engagement with the inner surface of brake cylinder 56, and allow the user to manually move work surface 12 vertically to a newly chosen position. Thereafter, mechanism 80 is released thereby permitting spring 92 in cooperation with gravity to return release bracket 88 to its initial lower position shown in FIG. 10. As a result, cam 74 is forced to pivot into its initial position and cause brake mechanism 20 to again become operative for purposes of retaining work surface 12 in user chosen position. As long as the force tending to lower work surface 12 remains in balance with the counterbalance force established by counterbalance mechanism 18, the above described operation may be repeated whenever the user desires to readjust the position of the work surface.

The mode of operation of the invention differs from that described above when the force tending to lower work surface 12 is no longer in balance with the counterbalance force, such as would be the case where a substantial load is added to or removed from the work surface without the user making a corresponding adjustment of rack and gear assembly 32 to change the moment arm through which spring 26 acts on member 22.

When for example, some unbalancing load is added to work surface 12, the force tending to lower the work surface exceeds the counterbalance force with the result that the work surface tends to move downwardly and cause member 22 to pivot in a clockwise direction, as viewed in FIG. 2. This movement results in pivot pin 64*d* being drawn towards the right hand end of slots 106 and 106, and interlock plate 100 being forced to pivot clockwise about the axis of pivot pin 104 into its first blocking position shown in FIG. 8. In this first blocking position of interlock plate 100, first blocking surface 110*a* is positioned to overlie bearing pin 90 and block upwardly directed movement thereof for purposes of releasing brake mechanism 20 upon subsequent user operation of mechanism 80. Damage to the release mechanisms, due to abutting engagement of bearing pin 90 with blocking surface 110*a*, is prevented by expansion of spring 86. Interlock plate 100 will remain in its first blocking position until the unbalancing load is removed from work surface 12 or rack and gear mechanism 32 adjusted by the user to increase the counterbalance force, as required to again balance the force tending to lower the work surface and permit the interlock plate to be returned to its neutral position shown in. FIG. 10.

On the other hand, when a load is removed from work surface 12, such that the counterbalance force becomes greater than the force tending to lower the work surface, the work surface tends to move upwardly and member 22 tends to pivot in. a counterclockwise direction, as viewed in FIG. 2. This movement results in pivot pin 64*d* being forced to move towards the left hand end of slots 106 and 106, and interlock plate 100 being forced to pivot counterclockwise about the axis of pivot pin 104 into its second blocking position as shown in FIG. 9. In this second blocking position of interlock plate 100, second blocking surface 110*b* is positioned to overlie bearing pin 90 and block upwardly directed movement thereof for purposes of releasing brake mechanism 20 upon subsequent user operation of mechanism 80. As with the case of engagement of bearing pin 90 with first blocking surface 110*a*, damage to the release mechanism due to abutting engagement of the bearing pin with second blocking surface 110*b*, is prevented by expansion of spring 86. Interlock plate 100 will remain in its second blocking position until return of the previously removed load to work surface 12 or rack and gear mechanism adjusted by the user to decrease the counterbalance force, as required to again balance the force tending to lower the work surface and permit the interlock plate to return to its neutral position.

The permitted extent of vertical movement of work surface 12 incident to the addition or removal of loads, is determined by the length of slots 106 and 106, and may for instance be as small as 3/16 inch.

The strength of spring 118 determines the change in work surface loading required to move the interlock plate from its neutral position, whereas the mode of mounting such spring, that is, the respective shapes/sizes of mounting openings 108 and 116 may be relied upon to require different loading changes to move the interlock plate into its first and second blocking positions. As by way of example, the lengths of the right hand legs of spring mounting opening 108 may be greater than that of the left hand legs of such opening, as shown in FIGS. 6 and 8–10, so as to require a greater loading change to move interlock plate 100 into its first blocking position than into its second blocking position. Alternatively, for example, spring 118 may be replaced by plural springs of differing strengths.

What we claim is:

1. The combination comprising:

surface means;

base means;

support means for supporting said surface means for movement relative to said base means through plural vertical positions;

a counterbalance mechanism for opposing downwardly directed movement of said surface means and including a member coupled to said base means and said support means, and user adjustable biasing means coupled to said base means and said member for establishing a counterbalance force acting on said surface and tending to oppose downwardly directed movement thereof;

brake means tending to retain said surface means in a user selected one of said vertical positions;

user operated release means for releasing said brake means; and interlock means for preventing release of said brake means in the event that said counterbalance force is less than or greater than a force tending to lower said surface means from said selected one of said positions, said interlock means includes an interlock plate having first and second blocking positions and a neutral position arranged intermediate said blocking positions, said interlock plate being supported by said base means for movement between said first and second blocking positions when said counterbalance force is less than and greater than said force, respectively, through a said neutral position when said counterbalance force corresponds essentially to said force; and said release means engages with said interlock plate when in said first and second blocking positions to prevent release of said brake means.

2. The combination according to claim 1, wherein said member is coupled to said interlock plate by said brake means.

3. The combination according to claim 1, wherein said interlock plate is pivotally supported by said base means for movement between said first and second blocking positions.

4. The combination according to claim 3, wherein said member is coupled to said interlock plate by said brake means by a pivot pin, and the extent of pivotal movement of said interlock plate between said blocking positions is limited by engagement of said pivot pin with said base means.

5. The combination according to claim 1, wherein said interlock plate defines downwardly facing first and second abutments disposed on horizontally opposite sides of a vertically upwardly extending passageway, and said release means includes a follower constrained for vertical movement along a is given path of travel, said interlock plate alternatively positioning said fist and second abutments for engagement by said follower when said interlock plate is in said first and second blocking positions, respectively, to prevent movement of said follower along said path of travel and said interlock plate permitting said follower to pass upwardly within said passageway along said path of travel when said interlock plate is in said neutral position whereby to permit release of said brake means by said release means.

6. The combination according to claim 5, wherein said interlock plate is pivotally supported by said base means for movement between said first and second blocking positions, and said follower is constrained against movement transversely of said path of travel by said base means.

7. The combination according to claim 6, wherein said member is coupled to said interlock plate by said brake means.

8. The combination according to claim 1, wherein said brake means includes a brake cylinder coupled to said member; a brake rod having a first end received within said brake cylinder and mounting a fist pressure applying member and a second end disposed outwardly of said brake cylinder and carrying a head member, said head member being pivotally connected to said interlock plate and provided with an elongated mounting opening and a bearing surface arranged intermediate said mounting opening and the pivotal connection of said head member and said interlock plate; a resiliently deformable piston head sized to be slidably received by said brake cylinder when in a non-deformed condition, said piston head having a through opening for receiving said brake rod adjacent said first pressure applying member; a pusher tube disposed concentrically outwardly of said brake rod and having a first end disposed within said brake cylinder and carrying a second pressure applying member and a second end disposed outwardly of said brake cylinder and carrying a slide member slidably engaging with said head member; a cam member supported for pivotal and sliding movement relative to said head member by a pivot pin received within said mounting opening said cam member being pivotally connected to said slide member by said pivot pin, said cam member having a cam surface arranged for engagement with said bearing surface being pivotally connected to said release means, characterized in that pivotal movement of said cam member relative to said head member in a fist direction by said release means causes said pin to move within said mounting opening away from said bearing surface resulting in sliding movement of said pusher tube lengthwise of said brake rod to effect compression of said piston head by clamping engagement of said first and second pressure applying members there with sufficiently to deform said piston head into frictional braking engagement with said brake cylinder, and in that pivotal movement of said cam member relative to said head member in a direction opposite to said first direction by said release means allows said pin to move within said mounting opening towards said bearing surface resulting in sliding movement of said pusher tube lengthwise of said brake rod relatively towards said head member incident to the tendency for said piston head to resiliently return to said non-deformed condition and move said second pressure applying member relatively away from said first pressure applying member.

9. The combination according to claim 8, wherein said base means is formed with a motion limiting opening and said head member is pivotally connected to said interlock plate by pivot pin received within said motion limiting opening for defining the limit of vertical movement of said surface means when said piston head is in frictional braking engagement with said brake cylinder.

10. The combination according to claim 8, wherein said release means includes a manual operator carried by said surface means; a release member carrying a follower and being pivotally connected to said cam member; means including a first spring for coupling said follower to said manual operator; and second spring for coupling said follower to said head member and tending to move said cam member in said first direction, and said follower engages with said interlock plate when in said blocking positions to prevent upwardly directed movement of said release member and resultant to pivotal movement of said cam member in said direction opposite to said first direction.

11. The combination according to claim 1, wherein said interlock plate is pivotally supported by said base means for movement between said blocking positions, and spring means are provided to bias said interlock plate into said neutral positions.

12. The combination according to claim 1, wherein said release means includes a follower; said base means constrains said follower for vertical movement along a path of travel; and said interlock plate includes first and second downwardly facing blocking surfaces disposed for abutting engagement by said follower when said interlock plate is alternatively arranged in said first and second blocking positions for preventing release of said brake means and a release passageway extending vertically intermediate said blocking surfaces and arranged for alignment with said follower when said interlock plate is disposed in said neutral position to permit movement of said follower upwardly within said release passageway along said path of travel to release said brake mechanism upon manual operation of said release means.

13. The combination according to claim 12, wherein said interlock plate is pivotally supported by said base means for movement between said blocking positions, and spring means is provided to bias said interlock plate into said neutral position.

14. The combination according to claim 13, wherein said member is coupled to said interlock plate by said brake means, and said brake means is coupled to said base means to permit a limited extent of vertical movement of said surface means while said surface means is retained in said user selected one of said vertical positions by said brake means.

15. The combination according to claim 14, wherein said brake means includes a brake cylinder coupled to said member; a brake rod having a first end received within said brake cylinder and mounting a fist pressure applying member and a second end disposed outwardly of said brake cylinder and carrying a head member, said head member being pivotally connected to said interlock plate and provided with an elongated mounting opening and a bearing surface arranged intermediate said mounting opening and the pivotal connection of said head member and said interlock plate; a resiliently deformable piston head sized to be slidably received by said brake cylinder when in a non-deformed condition, said piston head having a through opening for receiving said brake rod adjacent said first pressure applying member; a pusher tube disposed concentrically outwardly of said brake rod and having a first end disposed within said brake cylinder and carrying a second pressure applying member and a second end disposed outwardly of said brake cylinder and carrying a slide member slidably engaging with said head member; a cam member supported for pivotal and sliding movement relative to said head member by a pivot pin received within said mounting opening, said cam member being pivotally connected to said slide member by said pivot pin, said cam member having a cam surface arranged for engagement with said bearing surface being pivotally connected to said release means, characterized in that pivotal movement of said cam member relative to said head member in a first direction by said release means causes said pin to move within said mounting opening away from said bearing surface resulting in sliding movement of said pusher tube lengthwise of said brake rod to effect compression of said piston head by clamping engagement of said first and second pressure applying members therewith sufficiently to deform said piston head into frictional braking engagement with said brake cylinder, and in that pivotal movement of said cam member relative to said head member in a direction opposite to said first direction by said release means allows said pin to move within said mounting opening towards said bearing surface resulting in sliding movement of said pusher tube lengthwise of said brake rod relatively towards said head member incident to the tendency for said piston head to resiliently return to said non-deformed condition and move said second pressure applying member relatively away from said first pressure applying member.

* * * * *

UNITED STATES PATENT AND TRADEMARK OFFICE

CERTIFICATE OF CORRECTION

PATENT NO. : 6,443,075 B1
DATED : September 3, 2002
INVENTOR(S) : Christopher T. Hahn et al.

It is certified that error appears in the above-identified patent and that said Letters Patent is hereby corrected as shown below:

Column 1,
Line 29, replace “particulars” with -- particularly --
Line 47, replace “fist” with -- first --

Column 2,
Line 13, replace “thereof and” with -- thereof; and --
Line 16, replace “perm” with -- permit --

Column 3,
Line 13, replace “work surface 12” with -- work surface 12. --
Line 15, replace “prevented while” with -- prevented, while --
Line 16, replace “work. surface” with -- work surface --
Line 24, replace “first. pressure” with -- first pressure --
Line 28, replace “non-deformed. condition” with -- non-deformed condition --

Column 4,
Line 8, replace “102aof” with -- 102a of --

Column 5,
Line 14, replace “it.” with -- it --
Line 60, replace “in. FIG. 10.” with -- in FIG. 10. --
Line 65, replace “in.a” with -- in a --

Column 6,
Line 66, replace “through a said” with -- through said --

Column 7,
Line 22, replace “a is given” with -- a given --
Lines 23, 42 and 66, replace “fist” with -- first --
Line 61, replace “opening said cam” with -- opening; said cam --

UNITED STATES PATENT AND TRADEMARK OFFICE

CERTIFICATE OF CORRECTION

PATENT NO. : 6,443,075 B1
DATED : September 3, 2002
INVENTOR(S) : Christopher T. Hahn et al.

It is certified that error appears in the above-identified patent and that said Letters Patent is hereby corrected as shown below:

Column 9,
Line 4, replace "fist" with -- first --

Signed and Sealed this

Eighteenth Day of March, 2003

JAMES E. ROGAN
*Director of the United States Patent and Trademark Office*